US011291273B2

(12) United States Patent
Hartmann et al.

(10) Patent No.: US 11,291,273 B2
(45) Date of Patent: Apr. 5, 2022

(54) METHOD FOR PRODUCING A SHOE

(71) Applicant: PUMA SE, Herzogenaurach (DE)

(72) Inventors: Matthias Hartmann, Forchheim (DE); Romain Girard, Lauf an der Pegnitz (DE)

(73) Assignee: PUMA SE, Herzogenaurach (DE)

( * ) Notice: Subject to any disclaimer, the term of this patent is extended or adjusted under 35 U.S.C. 154(b) by 193 days.

(21) Appl. No.: 16/636,489

(22) PCT Filed: Aug. 11, 2017

(86) PCT No.: PCT/EP2017/000972
§ 371 (c)(1),
(2) Date: Feb. 4, 2020

(87) PCT Pub. No.: WO2019/029781
PCT Pub. Date: Feb. 14, 2019

(65) Prior Publication Data

US 2020/0245726 A1 Aug. 6, 2020

(51) Int. Cl.
*A43D 25/06* (2006.01)
*A43D 86/00* (2006.01)
(Continued)

(52) U.S. Cl.
CPC ..... *A43D 25/06* (2013.01); *A43D 86/00* (2013.01); *A43B 5/00* (2013.01); *A43B 9/02* (2013.01); *A43B 9/12* (2013.01); *A43B 13/04* (2013.01)

(58) Field of Classification Search
CPC ..... A43D 25/06; A43D 86/00; A43B 9/02; A43B 9/12; A43B 9/00; A43B 9/16; A43B 9/18
(Continued)

(56) References Cited

U.S. PATENT DOCUMENTS

D15,185 S 8/1884 Brooks
1,433,309 A 10/1922 Stimpson
(Continued)

FOREIGN PATENT DOCUMENTS

CN 2875129 Y 3/2007
CN 201005124 Y 1/2008
(Continued)

OTHER PUBLICATIONS

Notice of Reasons of Refusal issued in corresponding Japanese Application No. 2018-526089, dated Jun. 30, 2020, 11 pages.
(Continued)

*Primary Examiner* — Marie D Bays
(74) *Attorney, Agent, or Firm* — Quarles & Brady LLP

(57) ABSTRACT

The invention relates to a method for producing a shoe (1), in particular a sports shoe. In order to be able to produce the shoe economically and in the process to achieve a particularly good wearing comfort, the invention provides the steps of: a) Producing a shoe upper (2), wherein the shoe upper (2) has an upper region (3) that covers the upper region of the wearer's foot and a lower region (4) that encloses the sole of the wearer's foot; b) Producing a sole part (5), wherein the sole part (5) has a bottom region (6) and a lateral wall region (7), wherein the bottom region (6) and the wall region (7) delimit an upwardly open receiving space (8) for bulk material (9); c) Filling the receiving space (8) with a bulk material (9), wherein the bulk material consists at least in part, preferably entirely, of a thermoplastic elastomer (TPE); d) Fastening the shoe upper (2) to the sole part (5) such that the lower region (4) of the shoe upper (2) comes to rest on the bulk material (9).

20 Claims, 3 Drawing Sheets

Figure 1:
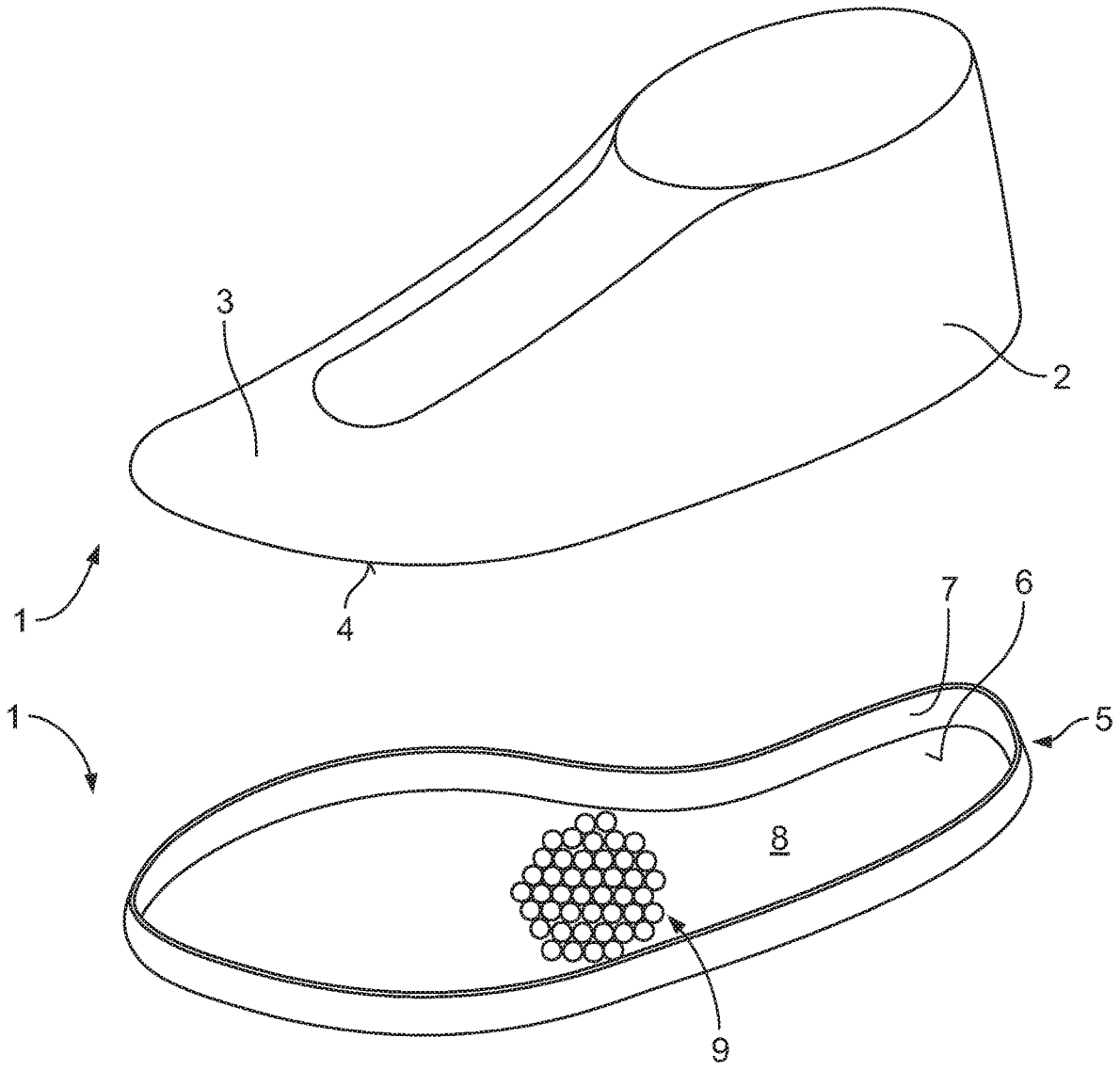

(51) Int. Cl.

| | |
|---|---|
| *A43B 5/00* | (2022.01) |
| *A43B 9/02* | (2006.01) |
| *A43B 9/12* | (2006.01) |
| *A43B 13/04* | (2006.01) |

(58) Field of Classification Search
USPC ..... 12/148, 142 RS, 142 T
See application file for complete search history.

(56) References Cited

U.S. PATENT DOCUMENTS

D79,583 S 10/1929 Cutler
D84,646 S 7/1931 Murray
D86,958 S 5/1932 Hakim
D90,233 S 7/1933 Daniels
D92,670 S 7/1934 Murray
D97,945 S 12/1935 Lutz
2,090,881 A 8/1937 Wilson
D132,621 S 6/1942 Ivan
D161,031 S 11/1950 MacLeod
2,641,004 A 6/1953 Whiting et al.
D171,331 S 1/1954 Haines et al.
3,087,262 A * 4/1963 Russell ..... A43B 13/181 36/28
D196,491 S 10/1963 Papoutsy
D206,222 S 11/1966 Mostile
3,469,576 A 9/1969 Smith
D216,246 S 12/1969 Mistarz
3,573,155 A 3/1971 Mitchell
3,629,051 A 12/1971 Mitchell
3,971,839 A 7/1976 Taylor
D241,484 S 9/1976 Castano
4,089,069 A 5/1978 Vistins
4,112,599 A 9/1978 Krippelz
D254,578 S 4/1980 Finn
D255,171 S 6/1980 Bowers
D255,178 S 6/1980 Fuzita
D255,286 S 6/1980 Fuzita
D256,067 S 7/1980 Hagg et al.
D263,348 S 3/1982 Cohen
D263,518 S 3/1982 Cohen
D265,017 S 6/1982 Vermonet
D265,019 S 6/1982 Vermonet
D265,437 S 7/1982 Vermonet
4,345,387 A 8/1982 Daswick
4,399,620 A * 8/1983 Funck ..... B29D 35/14 36/30 R
D272,963 S 3/1984 Muller et al.
D274,956 S 8/1984 Saruwatari
4,501,076 A * 2/1985 Dodds ..... A43B 3/14 12/142 MC
4,557,059 A 12/1985 Misevich et al.
D287,902 S 1/1987 Forsyth
4,658,515 A 4/1987 Oatman
D290,182 S 6/1987 Chen
D293,271 S 12/1987 Lussier
D293,275 S 12/1987 Bua
D293,620 S 1/1988 Liggett et al.
D295,917 S 5/1988 Brown et al.
D296,039 S 6/1988 Diaz
D296,149 S 6/1988 Diaz
D296,954 S 8/1988 Tong
D297,682 S 9/1988 Le
D298,483 S 11/1988 Liggett et al.
D298,582 S 11/1988 Caire
D299,581 S 1/1989 Friedenberg
4,843,741 A 7/1989 Yung-Mao
4,845,863 A 7/1989 Yung-Mao
4,858,340 A * 8/1989 Pasternak ..... A43B 7/28 36/88
D304,520 S 11/1989 Clark
D304,521 S 11/1989 Clark
D305,382 S 1/1990 Kiyosawa
D306,793 S 3/1990 Schwartz
D307,971 S 5/1990 Maccano et al.
D308,285 S 6/1990 Sema
D310,293 S 9/1990 Serna et al.
D310,295 S 9/1990 Boucher et al.
D311,989 S 11/1990 Parker et al.
D312,920 S 12/1990 Aveni
D313,113 S 12/1990 Aveni
D319,535 S 9/1991 Hatfield
D320,689 S 10/1991 Smith
D321,589 S 11/1991 Merk et al.
D321,973 S 12/1991 Hatfield
D321,974 S 12/1991 Hatfield
D324,762 S 3/1992 Hatfield
D324,940 S 3/1992 Claveria
5,092,060 A 3/1992 Frachey et al.
D328,815 S 8/1992 Legacki et al.
D329,528 S 9/1992 Hatfield
D329,940 S 10/1992 Hatfield
D330,454 S 10/1992 Elliot
5,152,081 A 10/1992 Hallenbeck et al.
D330,627 S 11/1992 Frachey et al.
D330,629 S 11/1992 Bramani
5,222,311 A 6/1993 Lin
D337,650 S 7/1993 Thomas, III et al.
D339,447 S 9/1993 McDonald
D339,448 S 9/1993 Teague
D339,454 S 9/1993 Hatfield
D339,675 S 9/1993 Austin
D339,906 S 10/1993 Frachey et al.
D340,349 S 10/1993 Kilgore et al.
D340,350 S 10/1993 Kilgore et al.
D340,797 S 11/1993 Pallera et al.
D341,700 S 11/1993 Avar
D343,044 S 1/1994 Kilgore et al.
5,313,717 A 5/1994 Allen et al.
5,329,705 A 7/1994 Grim et al.
D350,013 S 8/1994 Gitelman
D350,222 S 9/1994 Hase
5,383,290 A 1/1995 Grim
D356,438 S 3/1995 Opie et al.
D356,885 S 4/1995 Poole, Jr.
D362,956 S 10/1995 Martin et al.
D365,920 S 1/1996 Schneider
D366,955 S 2/1996 Valle
D371,896 S 7/1996 McMullin
D373,013 S 8/1996 Rosetta
5,542,195 A 8/1996 Sessa
D373,896 S 9/1996 Parker
5,575,088 A 11/1996 Allen et al.
5,595,005 A * 1/1997 Throneburg ..... A41B 11/00 36/10
5,607,749 A 3/1997 Strumor
D378,871 S 4/1997 Hatfield
D384,794 S 10/1997 Merceron
D386,589 S 11/1997 Cass
D386,590 S 11/1997 Cass
D386,591 S 11/1997 Kuerbis
D387,546 S 12/1997 Pearce
D389,991 S 2/1998 Elliott
D390,349 S 2/1998 Murai et al.
D391,045 S 2/1998 Assous
D391,748 S 3/1998 Koh
D393,299 S 4/1998 Hunt
D395,738 S 7/1998 Hatfield et al.
D396,341 S 7/1998 Lozano et al.
D397,236 S 8/1998 Wilmot
D398,740 S 9/1998 Hewett
D398,748 S 9/1998 Hatfield et al.
D399,041 S 10/1998 Teague
D400,345 S 11/1998 Teaque
D401,397 S 11/1998 Chen
D401,743 S 12/1998 Wunsch
D405,595 S 2/1999 Kayano
D407,892 S 4/1999 Gaudio
5,890,248 A * 4/1999 Gee ..... B29D 35/082 12/146 B
D411,579 S 6/1999 Dolinsky
5,909,719 A * 6/1999 Throneburg ..... A43D 3/023 12/142 R
D414,920 S 10/1999 Cahill

(56) References Cited

U.S. PATENT DOCUMENTS

D415,607 S 10/1999 Merceron
D415,610 S 10/1999 Cahill
D415,876 S 11/1999 Cahill
D416,669 S 11/1999 Parr et al.
5,996,252 A 12/1999 Cougar
D422,780 S 4/2000 Aguerre
D423,199 S 4/2000 Cahill
6,061,928 A * 5/2000 Nichols ..... A43B 13/181 36/28
D426,053 S 6/2000 Santa
6,076,283 A 6/2000 Boie
D429,874 S 8/2000 Gumbert
D431,346 S 10/2000 Birkenstock
6,127,010 A 10/2000 Franklin
6,187,837 B1 2/2001 Pearce
D442,767 S 5/2001 Della Valle
D444,620 S 7/2001 Della Valle
6,258,421 B1 7/2001 Potter
D446,002 S 8/2001 Leong et al.
D446,637 S 8/2001 Patterson et al.
D448,544 S 10/2001 Della Valle
6,308,438 B1 * 10/2001 Throneburg ..... A43B 1/02 36/11
6,314,661 B1 11/2001 Chern
6,341,432 B1 1/2002 Muller
D460,852 S 7/2002 Daudier
6,418,641 B1 7/2002 Schenkel
D461,299 S 8/2002 McClaskie
D461,947 S 8/2002 Merceron
D469,948 S 2/2003 Lin
D470,296 S 2/2003 Masullo
D474,330 S 5/2003 McClaskie
D475,512 S 6/2003 Chen
D479,643 S 9/2003 OShea et al.
D482,851 S 12/2003 McClaskie
D483,932 S 12/2003 Cooper
D485,973 S 2/2004 Adams
D489,880 S 5/2004 McClaskie
D490,223 S 5/2004 McClaskie
D490,233 S 5/2004 Cooper
6,739,074 B2 5/2004 Trommer
D492,101 S 6/2004 Issler
D492,475 S 7/2004 Adams
D494,343 S 8/2004 Morris
6,782,640 B2 8/2004 Westin
D495,861 S 9/2004 Georgiou et al.
D496,149 S 9/2004 Belley et al.
6,817,113 B2 11/2004 Pan
6,848,200 B1 2/2005 Westin
D506,305 S 6/2005 Link
D509,649 S 9/2005 McClaskie
6,948,264 B1 9/2005 Lyden
6,957,504 B2 10/2005 Morris
D511,037 S 11/2005 Della Valle
D511,610 S 11/2005 Della Valle
D512,208 S 12/2005 Kubo et al.
D513,836 S 1/2006 Magro et al.
D515,297 S 2/2006 Acheson
D522,740 S 6/2006 Dojan et al.
7,086,179 B2 8/2006 Dojan et al.
7,086,180 B2 8/2006 Dojan et al.
7,100,310 B2 9/2006 Foxen et al.
D532,599 S 11/2006 Dojan et al.
D532,600 S 11/2006 Dojan et al.
7,141,131 B2 11/2006 Foxen et al.
D534,345 S 1/2007 Dojan et al.
D538,017 S 3/2007 McClaskie
D539,517 S 4/2007 Issler
D540,517 S 4/2007 McClaskie
D547,541 S 7/2007 Schindler et al.
D548,435 S 8/2007 McClaskie
D549,934 S 9/2007 Horne et al.
D551,831 S 10/2007 Romero-Sanchez
D551,833 S 10/2007 Feller
D553,332 S 10/2007 McClaskie
D556,982 S 12/2007 Harper et al.
D560,883 S 2/2008 McClaskie
D561,433 S 2/2008 McClaskie
D564,736 S 3/2008 Belley et al.
D566,934 S 4/2008 Della Valle
D568,035 S 5/2008 McClaskie
D570,581 S 6/2008 Polegato Moretti
D571,085 S 6/2008 McClaskie
D571,987 S 7/2008 Della Valle
D572,440 S 7/2008 Polegato Moretti
D572,441 S 7/2008 Moretti
D572,442 S 7/2008 Polegato Moretti
7,401,420 B2 7/2008 Dojan et al.
D576,380 S 9/2008 Morris
D576,780 S 9/2008 Jolicoeur
7,441,419 B1 * 10/2008 Dollyhite ..... A61F 13/08 66/178 A
D586,090 S 2/2009 Turner et al.
7,484,318 B2 2/2009 Finkelstein
D590,140 S 4/2009 Della Valle
D591,494 S 5/2009 Jolicoeur
D591,938 S 5/2009 Beauger
D595,489 S 7/2009 McClaskie
D596,384 S 7/2009 Andersen et al.
7,555,848 B2 7/2009 Aveni et al.
7,556,846 B2 7/2009 Dojan et al.
7,559,107 B2 7/2009 Dojan et al.
7,562,469 B2 7/2009 Dojan
D597,286 S 8/2009 Della Valle et al.
D597,293 S 8/2009 Banik et al.
D599,091 S 9/2009 Della Valle et al.
D599,993 S 9/2009 Issler
D601,333 S 10/2009 McClaskie
D603,151 S 11/2009 Roundhouse
D604,033 S 11/2009 Feldman
D605,837 S 12/2009 Andersen et al.
D607,190 S 1/2010 McClaskie
D608,082 S 1/2010 Lemaster
D608,997 S 2/2010 Loverin
7,665,230 B2 2/2010 Dojan et al.
D610,788 S 3/2010 Della Valle
D611,233 S 3/2010 Della Valle et al.
7,676,955 B2 3/2010 Dojan et al.
7,676,956 B2 3/2010 Dojan et al.
7,703,219 B2 4/2010 Beck
D616,183 S 5/2010 Skaja
D616,640 S 6/2010 Werman
D617,540 S 6/2010 McClaskie
D620,695 S 8/2010 McCarthy et al.
D624,291 S 9/2010 Henderson
D625,499 S 10/2010 Della Valle et al.
7,805,859 B2 10/2010 Finkelstein
D626,321 S 11/2010 Cagner
7,841,108 B2 11/2010 Johnson et al.
D629,185 S 12/2010 Vico et al.
D631,237 S 1/2011 Genuin et al.
D631,646 S 2/2011 Muller
D633,286 S 3/2011 Skaja
D633,287 S 3/2011 Skaja
D636,156 S 4/2011 Della Valle et al.
D636,571 S 4/2011 Avar
D637,803 S 5/2011 Alvear et al.
D639,036 S 6/2011 Delavaldene et al.
D639,535 S 6/2011 Eggert et al.
8,079,159 B1 12/2011 Rosa
D661,073 S 6/2012 Della Valle et al.
D663,516 S 7/2012 Della Valle et al.
D668,845 S 10/2012 Huynh
D668,858 S 10/2012 Shaffer
D671,305 S 11/2012 Escobar
D671,306 S 11/2012 Tzenos
8,302,233 B2 11/2012 Spanks et al.
D674,171 S 1/2013 Bramani et al.
D680,710 S 4/2013 Sundberg
D683,119 S 5/2013 Shylion
D690,490 S 10/2013 Riddell
D693,553 S 11/2013 McClaskie
D694,501 S 12/2013 Miner
D696,501 S 12/2013 Miner

(56) References Cited

U.S. PATENT DOCUMENTS

D696,502 S 12/2013 Miner
D696,503 S 12/2013 Miner
D697,297 S 1/2014 McClaskie
8,657,979 B2 2/2014 Dojan et al.
8,671,591 B2 3/2014 Brown
D702,031 S 4/2014 Nakano
D707,934 S 7/2014 Petrie
D709,680 S 7/2014 Herath
D711,081 S 8/2014 Miner
D713,623 S 9/2014 Lo
D719,327 S 12/2014 Lindner et al.
D721,474 S 1/2015 Miner
D722,220 S 2/2015 Miner
D722,425 S 2/2015 Cin
8,961,844 B2 2/2015 Baghdadi et al.
D727,608 S 4/2015 Steven et al.
9,009,991 B2 4/2015 Sills
D730,638 S 6/2015 Christensen et al.
D731,763 S 6/2015 Solstad
D731,769 S 6/2015 Raysse
D734,600 S 7/2015 Gargiulo
D734,930 S 7/2015 Bikowski
9,078,493 B2 7/2015 Bradford
D737,548 S 9/2015 Levy
D738,078 S 9/2015 Raysse
D738,602 S 9/2015 Qin
D739,131 S 9/2015 Del Biondi
D739,132 S 9/2015 Dei Biondi
9,125,454 B2 9/2015 De Roode et al.
D740,003 S 10/2015 Herath
D740,004 S 10/2015 Hoellmueller et al.
D746,559 S 1/2016 Besanceney et al.
D753,381 S 4/2016 Ostapenko
D756,085 S 5/2016 Spring
D756,620 S 5/2016 Boys
D758,056 S 6/2016 Galway et al.
D759,358 S 6/2016 Cullen
D765,361 S 9/2016 Johnsongiflin
D765,362 S 9/2016 Kuerbis
D767,263 S 9/2016 Reiser
D773,161 S 12/2016 Teteriatnikov
D773,790 S 12/2016 Raysse
D773,791 S 12/2016 Raysse
D776,410 S 1/2017 Galway et al.
D781,543 S 3/2017 Raysse
D782,793 S 4/2017 Truelsen
D783,247 S 4/2017 McMillan
D783,974 S 4/2017 McMillan
9,610,746 B2 4/2017 Wardlaw et al.
D790,172 S 6/2017 Hatfield
D790,179 S 6/2017 McMillan
D790,181 S 6/2017 Parrett
9,682,522 B2 6/2017 Baghdadi et al.
D790,817 S 7/2017 Perkins et al.
D791,452 S 7/2017 Dombrow
D792,067 S 7/2017 Raysse
D793,053 S 8/2017 Cin
D793,680 S 8/2017 Lee
D793,687 S 8/2017 Cin
D793,688 S 8/2017 Avar et al.
D794,289 S 8/2017 Kanata
D794,300 S 8/2017 Rosen
9,743,705 B2 * 8/2017 Thomas ..... A43B 23/04
D796,170 S 9/2017 Raysse
D796,172 S 9/2017 Henrichot et al.
D797,417 S 9/2017 Lee et al.
D797,418 S 9/2017 Lee et al.
D797,420 S 9/2017 Nykreim
D798,553 S 10/2017 Lee
D799,178 S 10/2017 James
D799,183 S 10/2017 Weeks
D800,433 S 10/2017 Kuerbis
D801,011 S 10/2017 Del Biondi et al.
D801,015 S 10/2017 Gibson
9,775,769 B2 10/2017 Brown et al.
9,781,970 B2 10/2017 Wardlaw et al.
9,781,974 B2 10/2017 Reinhardt et al.
9,788,598 B2 10/2017 Reinhardt et al.
9,788,606 B2 10/2017 Reinhardt et al.
9,795,186 B2 10/2017 Reinhardt et al.
D801,653 S 11/2017 Small
D802,261 S 11/2017 Stillwagon
D802,270 S 11/2017 Kirschner
9,820,528 B2 11/2017 Reinhardt et al.
D805,745 S 12/2017 Link
9,849,645 B2 12/2017 Wardlaw et al.
D808,143 S 1/2018 Negri
D809,755 S 2/2018 Stavseng et al.
D809,756 S 2/2018 Stavseng et al.
D809,761 S 2/2018 Parrett
D810,407 S 2/2018 DeAlmeida
D811,062 S 2/2018 Teague
9,884,947 B2 2/2018 Prissok et al.
D811,714 S 3/2018 Ngene
D812,882 S 3/2018 Jenkins et al.
D813,508 S 3/2018 Weeks
9,907,365 B2 3/2018 Downing et al.
9,926,423 B2 3/2018 Baghdadi
D814,752 S 4/2018 Ormsby
9,930,928 B2 4/2018 Whiteman et al.
D816,958 S 5/2018 Cin et al.
9,961,961 B2 5/2018 Smith
9,968,157 B2 5/2018 Wardlaw et al.
D819,307 S 6/2018 Wurtz
D819,310 S 6/2018 Lashmore
D819,317 S 6/2018 Wurtz
D819,942 S 6/2018 Cin et al.
D823,583 S 7/2018 Petrie
10,039,342 B2 8/2018 Reinhardt et al.
D827,258 S 9/2018 Pina
D828,686 S 9/2018 Hoellmueller et al.
D828,984 S 9/2018 Gibson
D831,315 S 10/2018 Mahoney
D831,317 S 10/2018 Jenkins et al.
10,098,411 B2 * 10/2018 Hoffer ..... A43B 13/141
10,098,412 B2 * 10/2018 Hoffer ..... A43B 13/186
D833,129 S 11/2018 Fudalik
D834,801 S 12/2018 Ceniceros
10,149,512 B1 12/2018 Wurtz
D836,892 S 1/2019 Jenkins et al.
D836,893 S 1/2019 Bischoff et al.
D840,135 S 2/2019 Dombrow
D840,136 S 2/2019 Herath et al.
D840,137 S 2/2019 Herath et al.
10,226,099 B2 3/2019 Bischoff
10,227,467 B2 3/2019 Baghdadi
D844,952 S 4/2019 Taylor
D844,953 S 4/2019 Chen et al.
D846,255 S 4/2019 Khalife
D846,256 S 4/2019 Khalife
10,259,183 B2 4/2019 Wardlaw et al.
D847,475 S 5/2019 Khalife
D847,480 S 5/2019 Khalife
D848,715 S 5/2019 Holmes
D849,382 S 5/2019 Jenkins et al.
10,279,581 B2 5/2019 Ashcroft et al.
D850,083 S 6/2019 Jenkins et al.
D850,766 S 6/2019 Girard et al.
D851,889 S 6/2019 Dobson et al.
D852,475 S 7/2019 Hoellmueller
D852,476 S 7/2019 Hartmann
D853,094 S 7/2019 Young
D853,099 S 7/2019 Parrett
D853,690 S 7/2019 Taylor
D853,691 S 7/2019 Coonrod et al.
D853,699 S 7/2019 Coonrod et al.
D854,288 S 7/2019 Raasch
D854,294 S 7/2019 McMillan
D854,296 S 7/2019 Hardman
D854,297 S 7/2019 Hardman
D854,298 S 7/2019 Nethongkome
D855,297 S 8/2019 Motoki
D855,953 S 8/2019 Girard et al.
D856,650 S 8/2019 Schultze

(56) References Cited

U.S. PATENT DOCUMENTS

D857,360 S 8/2019 Hardy
D858,051 S 9/2019 Mace
D858,960 S 9/2019 Mace
D858,961 S 9/2019 Mace
D859,801 S 9/2019 Jenkins et al.
D860,616 S 9/2019 Cran
D862,047 S 10/2019 Patillon et al.
D862,051 S 10/2019 Goussev et al.
D864,540 S 10/2019 Rosen
D866,137 S 11/2019 Kanata
D866,144 S 11/2019 Kanata
D867,734 S 11/2019 Dieudonne
D867,737 S 11/2019 Kanata
D868,440 S 12/2019 Dieudonne
D869,833 S 12/2019 Hartmann
D870,433 S 12/2019 Hartmann
D871,731 S 1/2020 Behr
D871,732 S 1/2020 Behr
D872,436 S 1/2020 Matthews
D872,437 S 1/2020 Matthews
D872,438 S 1/2020 Matthews
D873,545 S 1/2020 Hartmann
D874,098 S 2/2020 Hartmann
D874,099 S 2/2020 Hartmann
D874,107 S 2/2020 Girard
D874,801 S 2/2020 Hartmann
D875,358 S 2/2020 Vella
D875,360 S 2/2020 Vella
D875,361 S 2/2020 Girard
D875,362 S 2/2020 Girard
D875,383 S 2/2020 Mace
D876,052 S 2/2020 Harlmnann
D876,055 S 2/2020 Hartmann
D876,063 S 2/2020 Matthews
D876,069 S 2/2020 Mace
D876,757 S 3/2020 Hartmann
D876,776 S 3/2020 Matthews
D876,791 S 3/2020 Gridley
D877,465 S 3/2020 Hartmann
D877,466 S 3/2020 Hartmann
D877,468 S 3/2020 Reyes
D878,015 S 3/2020 Harlmnann et al.
D878,021 S 3/2020 Mace
D878,025 S 3/2020 Hartmann
D879,424 S 3/2020 Hartmann et al.
D879,430 S 3/2020 Gerig
D880,126 S 4/2020 Powers
D880,822 S 4/2020 Harlmnann et al.
D880,825 S 4/2020 Garcia
D882,219 S 4/2020 Hartmann
D882,222 S 4/2020 Garcia
D882,227 S 4/2020 Braun et al.
D883,620 S 5/2020 Gridley
D883,621 S 5/2020 Garcia
D885,719 S 6/2020 Garcia
D885,721 S 6/2020 Williams
D885,722 S 6/2020 Le
D885,724 S 6/2020 Girard et al.
D887,112 S 6/2020 Mace
D887,113 S 6/2020 Girard et al.
D887,686 S 6/2020 Sogorb
D887,691 S 6/2020 Vella
D887,693 S 6/2020 Hartmann et al.
D889,788 S 7/2020 Yoshinaga et al.
D889,789 S 7/2020 Jenkins et al.
D889,815 S 7/2020 Mace
D890,485 S 7/2020 Perrault et al.
D890,488 S 7/2020 Vella
D890,496 S 7/2020 Le
D890,497 S 7/2020 Vella
D891,051 S 7/2020 Smith et al.
D891,053 S 7/2020 Dance
D891,054 S 7/2020 Dance
D891,738 S 8/2020 Garcia
D892,480 S 8/2020 Mace
D893,837 S 8/2020 Ni et al.
D893,838 S 8/2020 Le
D893,843 S 8/2020 Hartmann
D893,855 S 8/2020 Gridley
D894,572 S 9/2020 Lopez Cali
D896,485 S 9/2020 Williams
D902,539 S 11/2020 Mace
D903,252 S 12/2020 Vella
D905,942 S 12/2020 Dance
D906,653 S 1/2021 Le
D907,344 S 1/2021 Hartmann
D907,903 S 1/2021 Garcia
D909,723 S 2/2021 Girard et al.
D909,739 S 2/2021 Toelle
D910,290 S 2/2021 Girard et al.
D910,291 S 2/2021 Zeng
D911,682 S 3/2021 Girard et al.
D911,683 S 3/2021 Girard et al.
D913,647 S 3/2021 Garcia
D913,654 S 3/2021 Dance
D916,445 S 4/2021 Vella
D920,644 S 6/2021 Chipman
D920,645 S 6/2021 Chipman
D921,342 S 6/2021 Girard et al.
D922,042 S 6/2021 Girard et al.
D922,743 S 6/2021 Hardman
D928,479 S 8/2021 Le et al.
D930,961 S 9/2021 Le
2003/0046831 A1 3/2003 Westin
2003/0115691 A1 6/2003 Mukherjee et al.
2003/0208925 A1 11/2003 Pan
2004/0148805 A1 8/2004 Morris
2005/0022424 A1 2/2005 Held
2005/0188562 A1 9/2005 Clarke et al.
2005/0193592 A1* 9/2005 Dua ..... D04B 1/102 36/45
2005/0229431 A1 10/2005 Gerlin
2006/0021252 A1* 2/2006 Throneburg ..... A43B 17/023 36/44
2006/0026863 A1 2/2006 Liu
2006/0130363 A1* 6/2006 Hottinger ..... A43B 3/108 36/28
2006/0175036 A1 8/2006 Guerrero
2006/0277788 A1 12/2006 Fujii
2007/0011914 A1 1/2007 Keen et al.
2007/0094892 A1* 5/2007 Craig ..... A43B 7/1425 36/10
2008/0005936 A1 1/2008 Chiu
2008/0066341 A1 3/2008 Hottinger
2008/0110053 A1 5/2008 Dominquez et al.
2008/0148599 A1 6/2008 Collins
2008/0307679 A1 12/2008 Chiang et al.
2009/0013558 A1* 1/2009 Hazenberg ..... A43B 13/184 36/88
2010/0005684 A1 1/2010 Nishiwaki et al.
2010/0242309 A1 9/2010 McCann
2011/0099845 A1* 5/2011 Miller ..... A43B 7/1465 36/91
2011/0107622 A1 5/2011 Schwirian
2011/0131832 A1 6/2011 Brandt
2011/0252670 A1 10/2011 Smith
2012/0005920 A1 1/2012 Alvear et al.
2012/0023784 A1 2/2012 Goldston et al.
2012/0186107 A1 7/2012 Crary et al.
2012/0204451 A1 8/2012 De Roode et al.
2012/0210602 A1 8/2012 Brown
2013/0145653 A1 6/2013 Bradford
2013/0227858 A1 9/2013 James
2013/0247415 A1 9/2013 Kohatsu
2013/0291409 A1 11/2013 Reinhardt et al.
2014/0137434 A1 5/2014 Craig
2014/0150292 A1* 6/2014 Podhajny ..... A43B 23/0205 36/50.1
2014/0151918 A1 6/2014 Hartmann
2014/0223776 A1* 8/2014 Wardlaw ..... A43B 13/187 36/102
2014/0223777 A1 8/2014 Whiteman et al.

(56) References Cited

U.S. PATENT DOCUMENTS

| | | | | |
|---|---|---|---|---|
| 2014/0310986 | A1* | 10/2014 | Tamm | A43B 1/04 36/84 |
| 2015/0096203 | A1 | 4/2015 | Brown et al. | |
| 2015/0196085 | A1 | 7/2015 | Westmoreland et al. | |
| 2015/0250256 | A1* | 9/2015 | Podhajny | A43B 1/04 36/83 |
| 2015/0257481 | A1* | 9/2015 | Campos, II | A43B 13/20 36/103 |
| 2015/0342296 | A1* | 12/2015 | Skaja | A43B 23/026 36/83 |
| 2015/0351493 | A1 | 12/2015 | Ashcroft et al. | |
| 2016/0007676 | A1 | 1/2016 | Leimer et al. | |
| 2016/0037859 | A1 | 2/2016 | Smith et al. | |
| 2016/0044992 | A1 | 2/2016 | Reinhardt et al. | |
| 2016/0150855 | A1 | 6/2016 | Peyton | |
| 2016/0227876 | A1 | 8/2016 | Le et al. | |
| 2016/0278481 | A1 | 9/2016 | Le et al. | |
| 2016/0295955 | A1 | 10/2016 | Wardlaw et al. | |
| 2016/0302527 | A1* | 10/2016 | Meir | A43B 23/0245 |
| 2016/0374428 | A1 | 12/2016 | Kormann et al. | |
| 2017/0006958 | A1 | 1/2017 | Jeong | |
| 2017/0020228 | A1 | 1/2017 | Scofield et al. | |
| 2017/0253710 | A1 | 9/2017 | Smith et al. | |
| 2017/0259474 | A1 | 9/2017 | Holmes et al. | |
| 2017/0303635 | A1 | 10/2017 | Kazarian | |
| 2017/0341325 | A1 | 11/2017 | Le et al. | |
| 2017/0354568 | A1 | 12/2017 | Brown et al. | |
| 2018/0000197 | A1 | 1/2018 | Wardlaw et al. | |
| 2018/0035755 | A1 | 2/2018 | Reinhardt et al. | |
| 2018/0055137 | A1* | 3/2018 | Fraser | A43B 5/10 |
| 2018/0055144 | A1* | 3/2018 | Bischoff | A43B 13/206 |
| 2018/0064210 | A1 | 3/2018 | Turner et al. | |
| 2018/0077997 | A1* | 3/2018 | Hoffer | A43B 13/122 |
| 2018/0092432 | A1 | 4/2018 | Hoffer et al. | |
| 2018/0100049 | A1 | 4/2018 | Prissok et al. | |
| 2018/0103719 | A1 | 4/2018 | Chen | |
| 2018/0103725 | A1 | 4/2018 | Chen | |
| 2018/0132487 | A1 | 5/2018 | Kormann et al. | |
| 2018/0153252 | A1* | 6/2018 | Archer | A43B 23/0245 |
| 2018/0153264 | A1 | 6/2018 | Amos et al. | |
| 2018/0154598 | A1 | 6/2018 | Kurtz et al. | |
| 2018/0168281 | A1 | 6/2018 | Case et al. | |
| 2018/0199667 | A1 | 7/2018 | Wang | |
| 2018/0206591 | A1 | 7/2018 | Whiteman et al. | |
| 2018/0206599 | A1 | 7/2018 | Amos et al. | |
| 2018/0213886 | A1 | 8/2018 | Connell et al. | |
| 2018/0235310 | A1 | 8/2018 | Wardlaw et al. | |
| 2018/0271211 | A1 | 9/2018 | Perrault et al. | |
| 2018/0271213 | A1 | 9/2018 | Perrault et al. | |
| 2018/0289108 | A1 | 10/2018 | Hoffer et al. | |
| 2018/0296821 | A1 | 10/2018 | Ho | |
| 2018/0303197 | A1 | 10/2018 | Chen et al. | |
| 2018/0303198 | A1 | 10/2018 | Reinhardt et al. | |
| 2018/0317591 | A1 | 11/2018 | Hollinger | |
| 2018/0317600 | A1 | 11/2018 | Campos et al. | |
| 2018/0317603 | A1 | 11/2018 | Gronlykke | |
| 2018/0338575 | A1 | 11/2018 | Elder et al. | |
| 2018/0352900 | A1 | 12/2018 | Hartmann et al. | |
| 2019/0029363 | A1 | 1/2019 | Lucca | |
| 2019/0069633 | A1 | 3/2019 | Lucca | |
| 2019/0069634 | A1 | 3/2019 | Lucca | |
| 2019/0126580 | A1 | 5/2019 | Paulson et al. | |
| 2019/0133251 | A1 | 5/2019 | Hartmann et al. | |
| 2019/0150564 | A1 | 5/2019 | Bischoff | |
| 2019/0216167 | A1 | 7/2019 | Hoffer et al. | |
| 2019/0216168 | A1 | 7/2019 | Hoffer et al. | |
| 2019/0223539 | A1 | 7/2019 | Hoffer et al. | |
| 2019/0223550 | A1 | 7/2019 | Levy | |
| 2019/0223551 | A1 | 7/2019 | Hoffer et al. | |
| 2019/0269200 | A1 | 9/2019 | Tseng | |
| 2019/0283394 | A1 | 9/2019 | Ashcroft et al. | |
| 2020/0008518 | A1 | 1/2020 | Souyri et al. | |
| 2020/0060383 | A1 | 2/2020 | Le | |
| 2020/0077741 | A1 | 3/2020 | Hurd | |
| 2020/0093221 | A1 | 3/2020 | Caldwell et al. | |
| 2020/0107608 | A1 | 4/2020 | Uzzeni | |
| 2020/0170342 | A1 | 6/2020 | Uzzeni | |
| 2021/0022443 | A1 | 1/2021 | Hoffer et al. | |

FOREIGN PATENT DOCUMENTS

| | | | |
|---|---|---|---|
| CN | 101484033 | A | 7/2009 |
| CN | 201767147 | U | 3/2011 |
| CN | 103717658 | A | 4/2014 |
| CN | 103976505 | A | 8/2014 |
| CN | 104470393 | A | 3/2015 |
| CN | 105982390 | A | 10/2016 |
| CN | 107048590 | A | 8/2017 |
| CN | 107849286 | A | 3/2018 |
| CN | 207186082 | U | 4/2018 |
| DE | 102010046278 | A1 | 2/2011 |
| DE | 102011108744 | A1 | 1/2013 |
| EM | 001286116-0005 | | 7/2011 |
| EM | 002219956-0024 | | 4/2013 |
| EM | 002772764-0015 | | 9/2015 |
| EM | 003039619-0034 | | 3/2016 |
| EM | 003330174-0003 | | 3/2016 |
| EM | 003165984-0005 | | 6/2016 |
| EM | 003315555-0001 | | 7/2016 |
| EM | 003316389-0001 | | 7/2016 |
| EM | 003344076-0002 | | 8/2016 |
| EM | 003362672-0001 | | 9/2016 |
| EM | 003522580-0029 | | 12/2016 |
| EM | 003649060-0005 | | 1/2017 |
| EM | 003649540-0001 | | 1/2017 |
| EM | 003718311-0019 | | 1/2017 |
| EM | 003761089-0028 | | 2/2017 |
| EM | 003761113-0025 | | 2/2017 |
| EM | 004352755-0004 | | 9/2017 |
| EM | 004363935-0008 | | 9/2017 |
| EM | 004366326-0001 | | 9/2017 |
| EM | 004386571-0002 | | 10/2017 |
| EM | 004543882-0008 | | 12/2017 |
| EM | 004675411-0006 | | 1/2018 |
| EM | 004812501-0004 | | 3/2018 |
| EM | 005841939-0004 | | 3/2018 |
| EM | 005191004-0010 | | 4/2018 |
| EM | 005243227-0002 | | 4/2018 |
| EM | 005260023-0003 | | 5/2018 |
| EM | 005278413-0002 | | 5/2018 |
| EM | 005320371-0002 | | 6/2018 |
| EM | 005612025-0001 | | 8/2018 |
| EM | 006335345-0003 | | 3/2019 |
| EP | 0383685 | A1 | 8/1990 |
| EP | 1738889 | A1 | 1/2007 |
| EP | 1979401 | B1 | 9/2010 |
| EP | 2649896 | A2 | 10/2013 |
| EP | 2786670 | A1 | 10/2014 |
| EP | 2984956 | A1 | 2/2016 |
| EP | 3027377 | A1 | 6/2016 |
| EP | 3041892 | A1 | 7/2016 |
| EP | 2649896 | B1 | 10/2016 |
| EP | 3078287 | A1 | 10/2016 |
| EP | 3114959 | A1 | 1/2017 |
| EP | 3186306 | A1 | 7/2017 |
| EP | 2467037 | B1 | 10/2017 |
| EP | 2872309 | B1 | 11/2017 |
| EP | 3289907 | A1 | 3/2018 |
| EP | 3308663 | A1 | 4/2018 |
| EP | 3338581 | A1 | 6/2018 |
| EP | 3352607 | A1 | 8/2018 |
| EP | 3352608 | A1 | 8/2018 |
| EP | 3352610 | A1 | 8/2018 |
| EP | 3352611 | A1 | 8/2018 |
| EP | 3352612 | A1 | 8/2018 |
| EP | 3352615 | A1 | 8/2018 |
| EP | 3338984 | A3 | 9/2018 |
| EP | 3248770 | B1 | 5/2019 |
| EP | 3476237 | A1 | 5/2019 |
| EP | 3386334 | B1 | 7/2019 |
| FR | 2709047 | A1 | 2/1995 |
| JP | 10248610 | A | 9/1998 |
| JP | 1146806 | | 2/1999 |
| JP | 2000316606 | A | 11/2000 |

(56) References Cited

FOREIGN PATENT DOCUMENTS

| | | | |
|---|---|---|---|
| JP | 2002535468 | A | 10/2002 |
| JP | 2004161987 | A | 6/2004 |
| JP | 2007185353 | A | 7/2007 |
| JP | 2011177206 | A | 9/2011 |
| JP | 2014151210 | A | 8/2014 |
| JP | 2015077475 | A | 4/2015 |
| KR | 1020140025298 | A | 3/2014 |
| KR | 101550222 | B1 | 9/2015 |
| WO | 9929203 | A1 | 6/1999 |
| WO | 0101806 | A1 | 1/2001 |
| WO | 2005066250 | A1 | 7/2005 |
| WO | 2006066256 | A2 | 6/2006 |
| WO | 2007024523 | A1 | 3/2007 |
| WO | 2007082838 | A1 | 7/2007 |
| WO | 20070139832 | A2 | 12/2007 |
| WO | 2010010010 | A1 | 1/2010 |
| WO | 2016030026 | A1 | 3/2016 |
| WO | 2016030333 | A1 | 3/2016 |
| WO | 2017053650 | A1 | 3/2017 |
| WO | 2017053654 | A1 | 3/2017 |
| WO | 2017053658 | A1 | 3/2017 |
| WO | 2017053665 | A1 | 3/2017 |
| WO | 2017053669 | A1 | 3/2017 |
| WO | 2017053674 | A1 | 3/2017 |
| WO | 2017/097315 | A1 | 6/2017 |
| WO | 2018099833 | A1 | 6/2018 |
| WO | 2018103811 | A1 | 6/2018 |
| WO | DM102274-006 | | 7/2018 |
| WO | 2018169535 | A1 | 9/2018 |
| WO | 2018169537 | A1 | 9/2018 |
| WO | 2018175734 | A1 | 9/2018 |
| WO | DM103418-013 | | 10/2018 |
| WO | 2019029781 | A1 | 2/2019 |
| WO | 2019073607 | A1 | 4/2019 |
| WO | 2019101339 | A1 | 5/2019 |
| WO | 2019150492 | A1 | 8/2019 |

OTHER PUBLICATIONS

Office Action from corresponding Chinese Patent Application No. 201780093796.1, dated Jan. 27, 2021 (14 pages) (English translation included).

International Search Report for PCT/EP2017/000972, dated Oct. 25, 2017.

Mike Addresses Joyride Comparisons to Puma's Jamming Tech, SoleCollector.com, By Riley Jones, Aug. 7, 2019, 4 pages, [online], [site visited Sep. 4, 2019], <URL: https://solecollector.com/news/2019/08/nike-addresses-joyride-comprisons-puma-jamming> (Year: 2019).

Nike Unveils Joyride Running Shoes in Latest Cushioning Experiment, SI.com, By Chris Chavez, Jul. 25, 2019, 5 pages, [online], [site visited Sep. 4, 2019].<URL: https://www.si.com/edge/2019/07/25/nike-jpyride-technology-sushioning-beaded-tpe-foam-rubber-details> (Year: 2019).

Puma Jamming—NRGY Seeds Shoe Review, YouTube.com, Tiffany Beers, Published on Jul. 21, 2018, 1 page, [online], [site visited Sep. 4, 2019]. <URL: https://www.youtube.com/watch?v=4ZS7NDY0RNc> (Year: 2018).

First Office Action with First Search issued in corresponding Chinese Application No. 201580085133.6, dated Apr. 13, 2020, 15 pages.

First Office Action from corresponding Chinese Patent Application No. 201880090530.6 dated Jun. 3, 2021 (13 pages) (English translation included).

International Search Report (with English translation) and Written Opinion issued in International Application No. PCT/EP2015/002456, dated Oct. 25, 2016, 17 pages.

Adidas' FutureCraft Loop Sneaker Talks a Big Recycling Game, Gizmodo, Published on Apr. 17, 2019, 10 pages, [online], [site visited Sep. 5, 2019]. <URL: https://gizmodo.com/adidas-futurecraft-loop-sneaker-talks-a-big-recycling-1834086618> (Year: 2019).

Ben Felderstein "Puma to Debut New JAMMING Cushion on Nov. 9" © 2007-2019 Sneaker News Inc, Nov. 7, 2017, 7 pages, [online], [site visited Jul. 23, 2019] <URL: https://sneakernews.com/2017/11/07/puma-jamming-cushion-release-info/> (Year 2017).

Cruise Down the Streets in the Distinctive Puma Hybrid Runner, RunnersWorld.com, By Amanda Furrer, Jul. 2, 2018, 11 pages, [online], [site visited Jul. 26, 2019]. <URL: https://www.runnersworld.com/gear/a21987976/puma-hybrid-runner-shoe-review/> (Year: 2018).

Did Nike Not Get the Memo on Plastic Beads?, Gizmodo, Published on Jul. 25, 2019, 7 pages, [online], [site visited Sep. 5, 2019]. <URL: https://earther.gizmodo.com/did-nike-not-get-the-memo-on-plastic-beads-1836694806> (Year: 2019).

Puma Jamming NRGY Shoe Unboxing /Review+ On Feet, YouTube com, Published on Dec. 21, 2017, 1 page, [online], [site visited Jul. 26, 2019]. <URL: https://www.youtube.com/watch ?v=rpCmRWeDbj8> (Year: 2017).

The beads that move with you, PUMA Catch up, Published on Nov. 9, 2017, 6 pages, [online], [site visited Sep. 5, 2019]. <URL: https://www.puma-catchup.com/jamming-pumas-new-sole-technology-ultimate-comfort/> (Year: 2017).

The Puma Jamming Introduces New Cushioning Technology, Sneakers-Magazine.com, Posted Nov. 9, 2017, 3 pages, [online], [site visited Jul. 26, 2019], <URL: https://sneakers-magazine.com/puma-jamming-nrgy-beads/> (Year: 2017).

Adidas Mega Soft Cell, BX Sports's Weblog, Published on Aug. 6, 2010, [online], [site visited Jul. 29, 2019]. <URL: https://bx97.wordpress.com/2010/08/06/adidas-mega-soft-cell-2/> (Year: 2010).

Small beads for long distances, BASF, Published on Aug. 13, 2013, [online], [site visited Aug. 1, 2019]. <URL: https://www.basf.com/global/documents/en/news-and-media/science-around-us/small-beads-for-long-distances/BASF_Science_around_us_Infinergy.pdf> (Year: 2013).

Zaleski, Andrew, "Who's Winning the 3D-Printed Shoe Race?" Fortune.com; Published on Dec. 15, 2015 [online] [site visited Aug. 6, 2019] <URL: https://fortune.com/2015/12/15/3d-printed-shoe-race/> (Year 2015), pp. 1-12.

Schlemmer, Zack, "New Balance Trailbuster Fresh Foam Drops in Two Monochrome Colorways," Sneaker News; Published on Apr. 22, 2017 [online] [site visited Aug. 6, 2019] <URL: https://sneakernews.com/2017/04/22/new-balance-trailbuster-fresh-foam-drops-black-white/>(Year 2017), pp. 1-8.

International Search Report of International Application No. PCT/EP2018/060995, dated Jan. 17, 2019, 3 pages.

Hybrid NX Ozone Men's Running Shoes, US.Puma.com, [online], [site visited Sep. 8, 2020] <URL: https://us.puma.com/en/us/pd/hybrid-nx-ozone-mens-running-shoes/193384.html?dwvar 193384_color=06> (Year: 2020).

Hybrid Astro Men's Running Shoes, US.Puma.com, [online], [site visited Sep. 8, 2020]. <URL: https://us.puma.com/en/us/pd/hybrid-astro-mens-running-shoes/192799.html?dwvar 192799_color=07> (Year: 2020).

Office Action from corresponding Indian Application No. 201817021054 dated Nov. 10, 2021 (English translation included) (5 pages).

Office Action from corresponding Korean Application No. 10-2018-7016199 dated Dec. 22, 2021 (English translation included) (13 pages).

Second Office Action from corresponding Chinese Patent Application No. 201780093796.1 dated Aug. 25, 2021 (11 pages) (English translation included).

First Office Action from corresponding Japanese Patent Application No. 2020-546945 dated Nov. 2, 2021 (8 pages) (English translation included).

* cited by examiner

METHOD FOR PRODUCING A SHOE

This application is a U.S. National Stage application, filed pursuant to 35 U.S.C. § 371, of international application no. PCT/EP2017/000972, filed on Aug. 11, 2017, the contents of which is incorporated herein by reference in its entirety.

The invention relates to a method for producing a shoe, in particular a sports shoe.

The production of sports footwear is a well known technology. The aim is not only to provide an economical process for production, but also to have the possibility to influence the spring and damping behaviour of the shoe sole and thus of the shoe as much as possible. The material used also plays an important role in this process. Furthermore, a comfortable wearing comfort is aimed for.

In US 2009/0013558 A1, a shoe is described in which the sole of the shoe is made of different plastics that are bonded together using different polymer materials. In WO 2007/082838 A1 it is described that expanded thermoplastic polyurethane (E-TPU) can also be used advantageously for a shoe sole. This document also contains detailed information on this plastic material; in this respect, explicit reference is made to this document.

DE 10 2011 108 744 B4 also describes a shoe in which E-TPU is used as material for the sole. Here it is further described that individual foamed plastic spheres made of this material, which usually have a dimension of a few millimetres, are formed into the sole by adding a binding agent to a corresponding tool according to a possible processing form so that the plastic spheres are bonded together and form the moulded body of the sole. Another procedure is to inject steam under defined pressure into a mould in which the plastic spheres are inserted. This causes partial melting of the plastic material, so that the plastic spheres are bonded together and form the moulded body of the sole.

The properties of the shoe that can be achieved with this, especially with regard to its spring and damping behaviour, are not always fully satisfactory. Furthermore, the manufacturing process of the sole mentioned is sometimes relatively complex and therefore cost-intensive.

The invention is therefore based on the object of providing a process by which a shoe can be manufactured at low cost while achieving a particularly comfortable wearing comfort. Furthermore, the spring and damping behaviour of the shoe should be easily influenceable.

The solution of this object by the invention is characterized in that the method comprises the following steps:

a) Producing a shoe upper, wherein the shoe upper has an upper region that covers the upper region of the wearer's foot and a lower region that encloses the sole of the wearer's foot;
b) Producing a sole part, wherein the sole part has a bottom region and a lateral wall region, wherein the bottom region and the wall region delimit an upwardly open receiving space for bulk material;
c) Filling the receiving space with a bulk material, wherein the bulk material consists at least in part, preferably entirely, of a thermoplastic elastomer (TPE);
d) Fastening the shoe upper to the sole part such that the lower region of the shoe upper comes to rest on the bulk material.

The upper region and the lower region of the shoe upper are thereby preferably formed as a one-piece structure. The shoe upper can be formed as a sock-like structure. According to a preferred embodiment of the invention the shoe upper is produced as a knitted part so that it is produced on a knitting machine.

The upper region and the lower region of the shoe upper are preferably produced as a one-piece, preferably seamless, knitted part. In this case, circular knitting machines are preferably used, with which a circularly closed knitted fabric can be produced.

Of course, there are also other possibilities with which the shoe upper can be manufactured. In particular, it can be envisaged that the upper part of the shoe upper is produced in the traditional way, the lower region, which runs below the sole of the foot of the wearer of the shoe, being, for example, a strobel sole sewn to the upper part of the shoe upper. This can be done in particular in combination with a knitted upper region of the shoe upper.

The lower region of the shoe upper is preferably formed as a textile knitted fabric with a maximum thickness of 5 mm, preferably with a maximum thickness of 3 mm. This gives the wearer of the shoe a particularly advantageous wearing sensation, since the wearer—separated only by the thin lower region of the shoe upper—walking on the bulk material.

The sole part is preferably produced as an injection moulding part or as a thermoformed part.

Thereby it can be provided that at least one web-like structure is formed on the bottom region, which structure extends into the receiving space. This web-like structure forms wall areas within the receiving space, which counteracts the free movement of the loosely filled bulk material and holds it in certain areas of the receiving space. This has a positive effect on the walking sensation when wearing the shoe.

The mentioned web-like structure allows the sole to provide optimum support for the foot in certain applications when used properly under load. This may be relevant from the point of view of the fact that otherwise the (plastic) bodies located inside the receiving space of the sole part do not provide much support for the foot due to the fact that they are not connected to each other but loosely arranged.

When attaching the shoe upper part to the sole part as mentioned above, the two parts can be sewn and/or glued together.

Spherical or ellipsoid bodies are preferably used as bulk material. The bodies of the bulk material are preferably hollow. The dimensions of the bodies of the bulk material in the three spatial directions are preferably between 1 mm and 13 mm, particularly preferably between 3 mm and 6 mm.

The bodies of the bulk material preferably consist of foamed (i.e. expanded) thermoplastic elastomer.

It is particularly preferred that the bodies of the bulk material are made of thermoplastic polyurethane (TPU), thermoplastic polyamide (TPA) and/or olefin-based thermoplastic elastomer (TPO), wherein the mentioned materials are particular expanded (foamed).

The plastic bodies preferably have a hardness of between 75 and 90 Shore A, preferably between 80 and 85 Shore A. They preferably have a bulk density between 100 and 300 $kg/m^3$.

With regard to the expanded thermoplastic polyurethane (E-TPU), which is the preferred material for the plastic bodies which are inserted into the receiving space of the sole part, the following should be mentioned: This material is known per se and is used in shoes. It is available under the name "PearlFoam" from Huntsman International LLC or under the name "Infinergy" from BASF SE, for example. With regard to this material, explicit reference is made to WO 2005/066250 A1, where details on this material, i.e. expandable thermoplastic polyurethanes and their production, can be found.

With regard to the prior knowledge of urethane-based thermoplastic elastomers, reference is also explicitly made to WO 2010/010010 A1, which discloses an expandable, blowing agent-containing thermoplastic polymer blend containing thermoplastic polyurethane and styrene polymer. The polymer blend may contain at least one further thermoplastic polymer. Possible further thermoplastic polymers are in particular polyamide (PA), polymethyl methacrylate (PMMA), polycarbonate (PC), polyethylene (PE), polypropylene (PP), polyvinyl chloride (PVC), cellulose or polyoxymethylene (POM).

The sole part preferably consists of thermoplastic polyurethane (TPU), thermoplastic elastomer (TPE), polyamide (PA) and/or rubber material.

Since we speak of bulk material in connection with the bodies to be introduced into the receiving space, these are individual particles that have no connection to each other. In particular, according to a preferred embodiment of the invention, the plastic bodies are placed in the receiving space of the sole part without connection to each other. Accordingly, the individual spheres or ellipsoids are not connected to each other by any means, but are placed loosely in the receiving space of the sole part.

The bulk material is preferably placed in full packing and preferably under slight pressure in the receiving space of the sole section.

Beneficially, the proposed process allows the cost-effective production of a shoe that is comfortable to wear, whereby it is advantageous to avoid the use of an inner sole or inserted sole.

If required, the aforementioned part of the sole can also be provided with an outer sole on the underside.

It has been shown that when a shoe, especially a sports shoe, is designed in the manner specified above, very advantageous and comfortable wearing properties of the shoe can be achieved with regard to the compression behaviour of the shoe and its recovery properties (after the compressive force is removed by the wearer's foot). This is especially true under the aspect of strong temperature fluctuations.

If the proposed thermoplastic elastomers (in distinction to common polymers) are used as loose bulk material in the cavity of the sole, the frictional properties between the individual particles result in favourable conditions, as they do not slide along each other in an undesirable way, but provide a certain degree of strength despite their loose arrangement when the foot of the wearer deforms the bulk material. Thus, an optimal compromise between a certain massage effect on the one hand and a sufficient hold of the foot while using the shoe on the other hand is achieved.

In the drawings an embodiment of the invention is shown.

Figure 2:
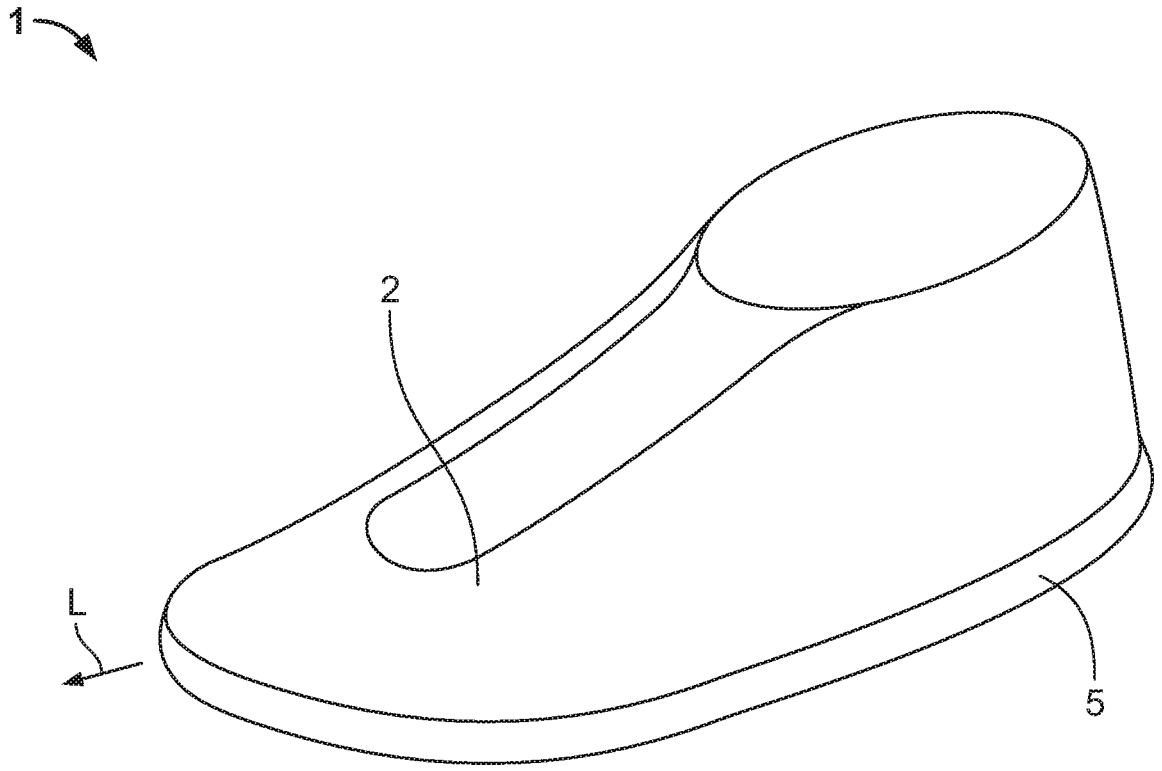
Figure 3:
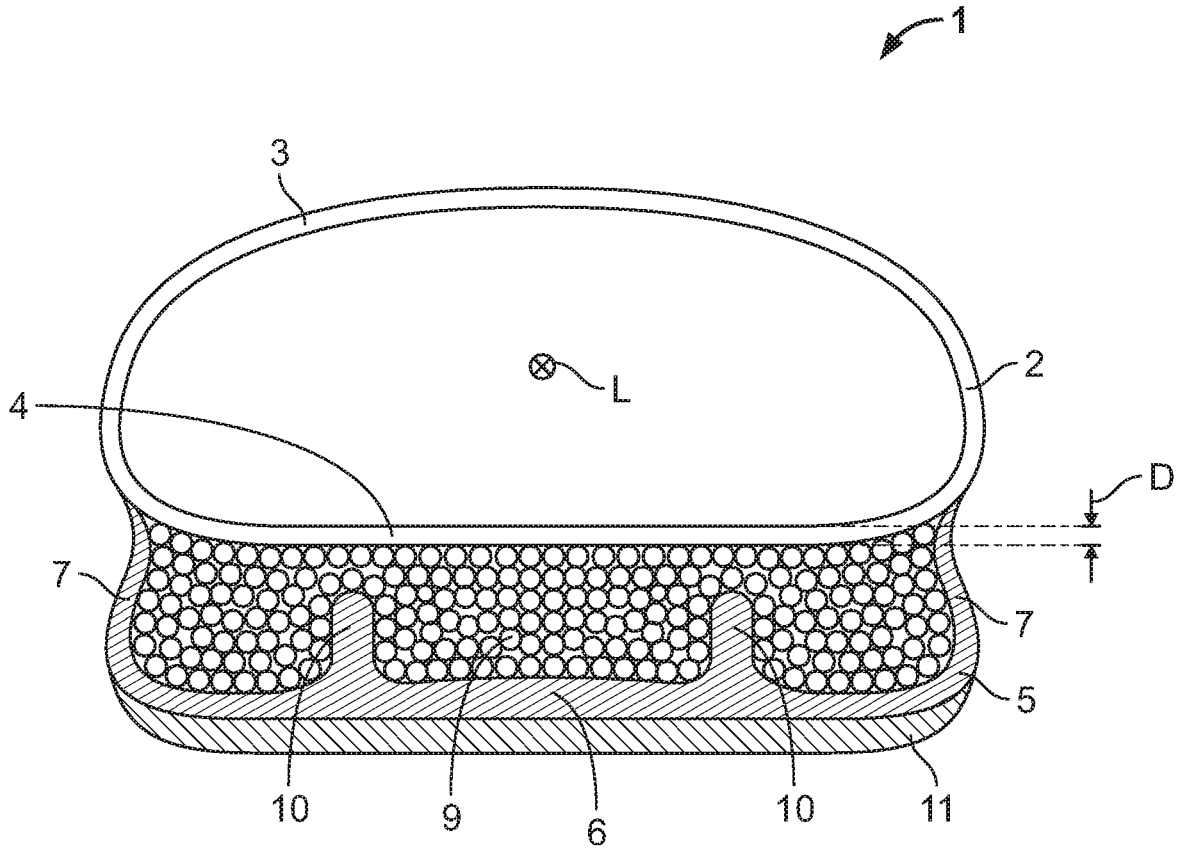

FIG. 1 shows schematically a shoe upper and a sole part of a shoe, whereby these are not yet joined together, FIG. 2 shows the finished shoe, in which the shoe upper and the sole as shown in Figure are joined together 1, and FIG. 3 shows the finished shoe in a section perpendicular to the longitudinal axis of the shoe.

FIG. 1 shows a shoe upper 2 and a sole part 5, which together make up a shoe 1, wherein the two parts 2 and 5 are not yet connected. The designations "top" and "bottom" refer to the intended use of the shoe or when the shoe is standing on the ground.

In the first phase of the production of shoe 1, the shoe upper 2 and the sole part 5 are produced each.

In the case of shoe upper 2, a knitting process is used according to a preferred solution, producing a sock-like structure as shown in FIG. 1. Circular knitting machines, for example, are used here which can produce the entire sock-like structure in one production step. Here, the shoe upper part 2 has an upper region 3 which, among other things, covers the instep of the wearer's foot, and a lower region 4 which, when the shoe is used as intended, lies under the sole of the wearer's foot. The entire shoe upper 2 is designed as a one-piece knitted fabric.

The sole part 5 can be produced by an injection moulding process or by a thermoforming process, for example. As can be seen in FIG. 1, the sole part 5 has a bottom region 6 and a lateral wall region 7, which in this case is formed as a circumferential edge. The bottom region 6 and the wall region 7 form a receiving space 8 which is open at the top.

After the shoe upper 2 and the sole part 3 have been produced (which can be done simultaneously or in any order with a time delay), the receiving space 8 is filled with bulk material 9, which is only indicated in FIG. 1.

As can be seen from the other figures, the bulk material 9 is placed in the receiving space 8 in its entirety and, if necessary, under slight pressure. The shoe upper 2 is then placed on the sole part 3 so prepared and the sole part 5 is connected to the shoe upper 2. This can be done by sewing and/or gluing.

Accordingly, the lower region 4 of the shoe upper 2 now lies directly on the bulk material 9, so that a comfortable walking feeling is created when using the shoe.

Any material is generally used as bulk material 9 (e.g. also sand), while spheres or ellipsoids made of foamed plastic material are preferred; details are given above.

To ensure that the bulk material 9 in the receiving space 8 has a certain stability when it is displaced by the foot of the wearer as a result of the weight force, web-like structures 10 can be formed in the bottom region 6 of the sole part 5. These structures 10 prevent the bulk material 9 from shifting sideways, so that the stability of the shoe and especially of the sole can be increased.

FIG. 3 shows a section through the finished shoe perpendicular to the longitudinal direction L of shoe 1. Here it can be seen that an outer sole 11 has been added below the explained sole part 5, which can be done by gluing it on, for example.

In this figure it can also be seen that the lower region 4 of the shoe upper 2 is relatively thin. The thickness D is indicated, which is preferably maximal 3 mm. This provides a pleasant wearing sensation, as the foot of the wearer of the shoe runs almost like on sand, as the individual particles of the bulk material 9 have no connection to each other.

By selecting the material-specific and geometric parameters (dimensions of the particles of the bulk material, dimensions of the individual areas of the shoe upper and the sole part, choice of material, etc.), it is possible to influence the spring and dampening behaviour of the shoe and especially the sole.

This applies in particular also to the optional selection and design of the web-like structure 10, for which round or polygon-like chamber sections, which are open at the top, can also be provided.

It is not illustrated that inserts may be manufactured and connected to sole part 5 in order to reinforce specific areas of the sole. In this way, special areas of the sole can be provided with greater stability, wherein specifically the supporting function of the shoe and especially of the sole can be influenced.

An advantageous embodiment can look as follows:

Hollow bodies (in particular spheres or ellipsoids) consisting of thermoplastic polyurethane (TPU) (possibly also expanded TPU) can be used as bulk material, preferably with a diameter between 3 and 15 mm; a diameter range between 5 and 8 mm is particularly preferred.

These hollow bodies can be produced by injection moulding, blow moulding or laser sintering, for example.

The surface of the hollow bodies can be partially open or completely closed. If hollow bodies are closed, they contain air. One of the characteristics of the bodies is that, when compressed, they exhibit a strongly non-linear progression of the deformation force over the deformation. Accordingly, the hollow body can be deformed or compressed relatively easily to a certain extent, and from a certain degree of deformation the resistance to further deformation increases sharply, i.e. it is now more difficult to deform the hollow body further.

This behaviour can be very advantageous for damping systems in the field of sports and here especially for shoe soles (also midsoles or insoles).

The bodies of the bulk material can be transparent.

The hardness of the starting material of TPU hollow bodies is preferably in the range between 70 and 95 Shore A.

The hollow bodies completely regain their original shape after the external force is removed. Mixing with other materials (e.g. PU foam or E-TPU or E-TPE materials) is possible in order to influence the damping properties advantageously. The combination with other materials can be done by a "PU Casting Process". In this case, for example, it can be provided that the hollow bodies consist of 80% TPU and 20% PU foam as a binder. In particular, a combination with E-TPU or E-TPE material is also possible.

The hollow bodies can be produced by welding or by using microwaves by joining two hemispheres or half-shells together. Circular webs can form at the joint, which can have a positive effect on the stiffness in the desired manner.

While, as shown above, a loose insertion of individual bodies in the form of bulk material is provided for, there is also the possibility in principle that the aforementioned bodies made of the materials mentioned are also at least partially coupled or joined together. In this respect it is possible to create a structure in which a number of bodies, preferably hollow bodies, are joined together, for example by microwave welding.

A similar composite of individual bodies can also be created by embedding the individual bodies, especially hollow bodies, in a plastic foam, especially polyurethane foam, thus creating a structure that can be used to build the sole of the shoe.

REFERENCE NUMERALS

1 Shoe
2 Shoe upper
3 upper region of the shoe upper
4 lower region of the shoe upper
5 Sole part
6 Bottom region
7 Wall region
8 Receiving space
9 Bulk material
10 Web-like structure
11 Outer sole
D Thickness of the lower region of the shoe upper
L Longitudinal direction of the shoe

The invention claimed is:

1. A method for producing a shoe, the method comprising:
producing a shoe upper having an upper region that covers an upper region of a wearer's foot and a lower region that encloses a sole of the wearer's foot;
producing a sole part having a bottom region and a lateral wall region that extends upwardly from the bottom region, such that the bottom region and the lateral wall region delimit an upwardly open receiving space;
filling the receiving space with a bulk material comprising a thermoplastic elastomer (TPE); and
fastening the shoe upper to the sole part, such that the lower region of the shoe upper contacts the bulk material,
wherein at least one support structure is formed on the bottom region of the sole part, the support structure extending from the bottom region within the receiving space to a distance that is less than a length of the lateral wall region of the sole part, such that a gap between the lower region of the shoe upper and the support structure is filled with the bulk material.

2. The method of claim 1, wherein the upper region and the lower region of the shoe upper are formed as a one-piece structure.

3. The method of claim 1, wherein the shoe upper is formed as a sock structure.

4. The method of claim 1, wherein the shoe upper is produced on a knitting machine.

5. The method of claim 4, wherein the upper region and the lower region of the shoe upper are produced as a one-piece knitted part.

6. The method of claim 1, wherein the lower region of the shoe upper is formed as a textile knitted fabric with a maximum thickness of 5 mm.

7. The method of claim 1, wherein the sole part is produced as an injection moulded part.

8. The method of claim 1, wherein the sole part is produced as a thermoformed part.

9. The method of claim 1, wherein the shoe upper is sewn and/or glued to the sole part.

10. The method of claim 1, wherein the bulk material comprises spherical or ellipsoidal bodies.

11. The method of claim 10, wherein the bodies of the bulk material are formed as hollow bodies.

12. The method of claim 10, wherein the dimensions of the bodies of the bulk material in three spatial directions are between 1 mm and 13 mm.

13. The method of claim 11, wherein the bodies of the bulk material comprise a foamed thermoplastic elastomer.

14. The method of claim 10, wherein the bodies of the bulk material comprise expanded thermoplastic polyurethane (TPU), expanded thermoplastic polyamide (TPA), and/or expanded thermoplastic elastomer based on olefin (TPO).

15. A method for producing a shoe, comprising:
producing a shoe upper having an upper region that covers an upper region of a wearer's foot and a lower region that encloses a sole of the wearer's foot;
producing a sole part having a bottom region and a lateral wall region extending upwardly from the bottom region, such that the bottom region and the lateral wall region delimit an upwardly open receiving space;
filling the receiving space with a bulk material; and
fastening the shoe upper to the sole part such that the lower region of the shoe upper contacts the bulk material, wherein a support structure is formed on the bottom region of the sole part, the support structure extending from the bottom region and at least partially into the receiving space, such that the lower region of the shoe upper does not contact the support structure, and wherein the support structure defines a plurality of round or polygonal shaped chamber sections.

16. The method of claim 15, wherein the bulk material comprises partly individual loose bodies and partly interconnected bodies.

17. The method of claim 16, wherein at least a portion of the individual loose bodies of the bulk material are spherical or ellipsoidal bodies.

18. The method of claim 16, wherein at least a portion of the individual loose bodies of the bulk material are hollow bodies.

19. The method of claim 16, wherein the bulk material comprises a thermoplastic elastomer (TPE).

20. The method of claim 19, wherein the interconnected bodies of the bulk material are joined together by microwave welding.

* * * * *